US006205224B1

(12) United States Patent
Underbrink

(10) Patent No.: US 6,205,224 B1
(45) Date of Patent: Mar. 20, 2001

(54) CIRCULARLY SYMMETRIC, ZERO REDUNDANCY, PLANAR ARRAY HAVING BROAD FREQUENCY RANGE APPLICATIONS

(75) Inventor: James R. Underbrink, Seattle, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 08/652,629

(22) Filed: May 17, 1996

(51) Int. Cl.[7] ..... H04R 3/00
(52) U.S. Cl. ..... 381/92; 343/893; 367/905
(58) Field of Search ..... 381/92; 367/118, 367/119, 122, 123, 905, 126; 343/895, 844, 893

(56) References Cited

U.S. PATENT DOCUMENTS

| | | | | |
|---|---|---|---|---|
| 3,524,188 | | 8/1970 | Bowman | 343/754 |
| 3,811,129 | | 5/1974 | Holst | 343/844 |
| 4,060,792 | * | 11/1977 | Van Heyningen | 367/905 |
| 4,169,257 | * | 9/1979 | Smith | 367/905 |
| 4,363,115 | * | 12/1982 | Cuomo | 367/905 |
| 4,420,825 | * | 12/1983 | Maynard et al. | 367/122 |
| 4,525,816 | * | 7/1985 | Crowther | 367/905 |
| 4,559,605 | * | 12/1985 | Norsworthy | 367/122 |
| 4,905,011 | | 2/1990 | Shea | 342/361 |
| 5,151,705 | | 9/1992 | Badger et al. | 342/368 |
| 5,838,284 | * | 11/1998 | Dougherty | 343/893 |

OTHER PUBLICATIONS

IEE Proceedings—Microwaves, Antennas and Propagation, Aug. 1994, UK, vol. 141, No. 4, ISSN 1350–2417, pp. 321–325, XP002038893 Hall P.S. et al.: "Sequentially rotated arrays with reduced sidelobe levels" (p. 323–p. 325).

* cited by examiner

*Primary Examiner*—Vivian Chang
(74) *Attorney, Agent, or Firm*—Conrad O. Gardner

(57) ABSTRACT

A class of planar arrays having broad frequency range applications for source location, source imaging or target illumination with projected beams is described in this disclosure. The non-redundant arrays are circularly symmetric and made up of a plurality of sensing and/or transmitting elements arranged so as to substantially eliminate grating lobes for a broad range of frequencies. Signals received from or transmitted to the elements are appropriately phased to control the beam of the array.

18 Claims, 11 Drawing Sheets

CIRCULARLY SYMMETRIC, ZERO REDUNDANCY, PLANAR ARRAY HAVING BROAD FREQUENCY RANGE APPLICATIONS

BACKGROUND OF THE INVENTION

The present invention relates to planar arrays having broad frequency range applications for source location, source imaging or target illumination with projected beams. Prior attempts to address planar array design where the number of array elements is restricted focus on single frequency application, don't address the issue of circular symmetry, and/or are for far-field application and thus do not comprehensively address near-field, circularly symmetric, and broad band application for source mapping or target illumination with projected beams.

Regular arrays are known in the state of the art whereby array elements are placed in a periodic arrangement such as a square, triangle, or hexagonal grid. In these arrangements, adjacent elements are required to be spaced within one-half wavelength of each other to prevent the array pattern from having multiple mainlobes in other than the steered direction, a phenomenon commonly referred to as spatial aliasing or grating lobes. This half-wavelength requirement can be cost prohibitive from the standpoint of the number of array elements required in broad frequency range applications because the lowest frequency for intended use drives the array aperture size larger (to achieve adequate array resolution), while the highest frequency drives the element spacing smaller (to avoid spatial aliasing).

Irregular arrays are known in the state of the art for providing a way to address grating lobe problems inherent in regular arrays because irregular arrays eliminate periodicities in the element locations. Random arrays are known in the state of the art as one form of irregular array. Random arrays are limited in ability to predictably control worst case sidelobes. When array element location can be controlled, an algorithm may be used to determine element placement that will guarantee irregular spacing and allow for more predictable control of worst case sidelobes. Prior art contains many examples of irregularly spaced linear arrays many of which are non-redundant, that is, no spacing between any given pair of elements is repeated. Non-redundancy provides a degree of optimality in array design with respect to controlling grating lobes.

Prior art for designing irregular planar arrays is largely ad-hoc. Only a few simple examples of non-redundant planar arrays—where there is either a relatively small number of elements or a simplistic element distribution such as around the perimeter of a circle—appear to exist in prior art. Prior art appears void of non-redundant planar array design techniques for locating an arbitrary number of elements distributed throughout the array aperture (as opposed to just around the perimeter) in a controlled manner to ensure non-redundancy and circular symmetry.

It is one object of the present invention to provide a planar array design substantially absent of grating lobes across a broad range of frequencies where the available number of elements is substantially less than that required to construct a regular (i.e., equally spaced element) array with inter-element spacing meeting the half-wavelength criteria typically required to avoid grating lobe contamination in source maps or projected beams.

Another objective of the present invention is to provide a planar array design that provides circular symmetry so that the source map resolution or projected beamwidth is not substantially array-dimension (i.e., azimuthal angle) dependent.

A further object of the invention is to provide a planar array design that makes optimal use of a fixed number of array elements in the sense that the array is non-redundant.

Still another object of the invention is to provide space density tapering flexibility in the array design to allow for trade-offs in the array design between array beamwidth and sidelobe levels.

Yet another object of the present invention is to provide a general method for distributing an arbitrary number of elements on an arbitrary diameter circular planar aperture in a manner that guarantees circular symmetry and non-redundancy in the spatial sampling space.

SUMMARY OF THE INVENTION

A planar array of sensing or transmitting elements (e.g., microphones or antennas) spaced on a variety of arc lengths and radii along a set of identical logarithmic spirals, where members of the set of spirals are uniformly spaced in angle about an origin point, having lower worst-case sidelobes and better grating lobe reduction across a broad range of frequencies than arrays with uniformly distributed elements (e.g., square or rectangular grid) or random arrays. The array is circularly symmetric and when there are an odd number of spirals, the array is non-redundant. A preferred spiral specification embodiment combines the location of array elements on concentric circles forming the geometric radial center of equal-area annuli with locations on an innermost concentric circle whose radius is independently selected to enhance the performance of the array for the highest frequencies at which it will be used. This result applies over a broad wavelength band, e.g. 10:1 ratio, making it useful for phased acoustic microphone or speaker arrays, or for phased electromagnetic antenna arrays. For small numbers of array elements, it is superior to a random array. Alternate spiral specification embodiments provide array space density tapering alternatives allowing for flexibility in array design and for array performance trade-offs between array beamwidth and sidelobe levels.

BRIEF DESCRIPTION OF THE DRAWINGS

The aforementioned and other objects and features of the present invention will become clear from the following description taken in conjunction with the preferred embodiments thereof with reference to the accompanying drawings throughout which like parts are designated by like reference numerals, and in which.

DESCRIPTION OF THE INVENTION

Figure 1:
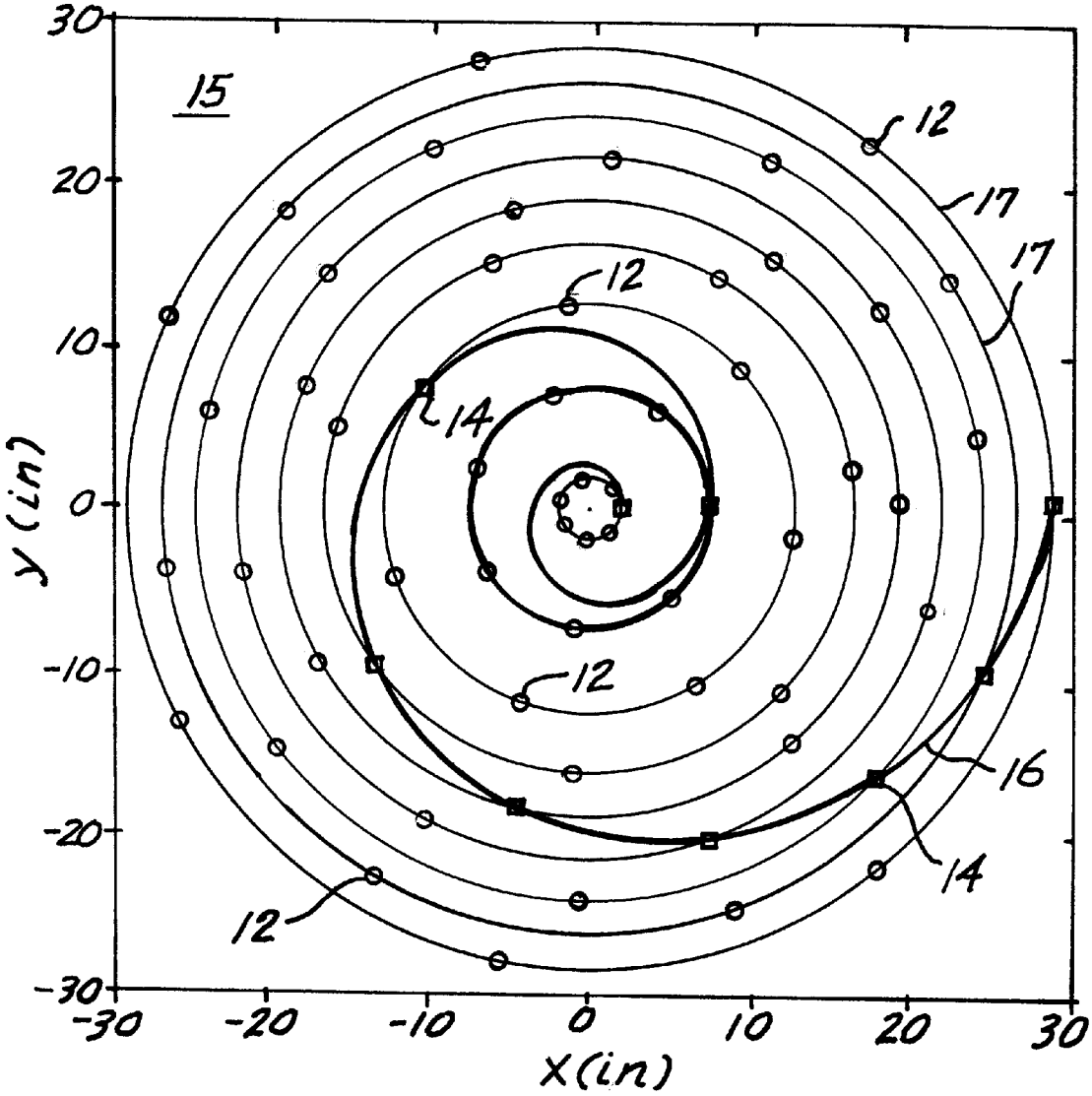
FIG. 1 is a diagrammatic view of a circular planar array made up of multiple logarithmic spiral shaped arrays with equi-annular area spaced elements in accordance with an embodiment of the invention wherein array elements from one of the spirals are highlighted.
Figure 2:
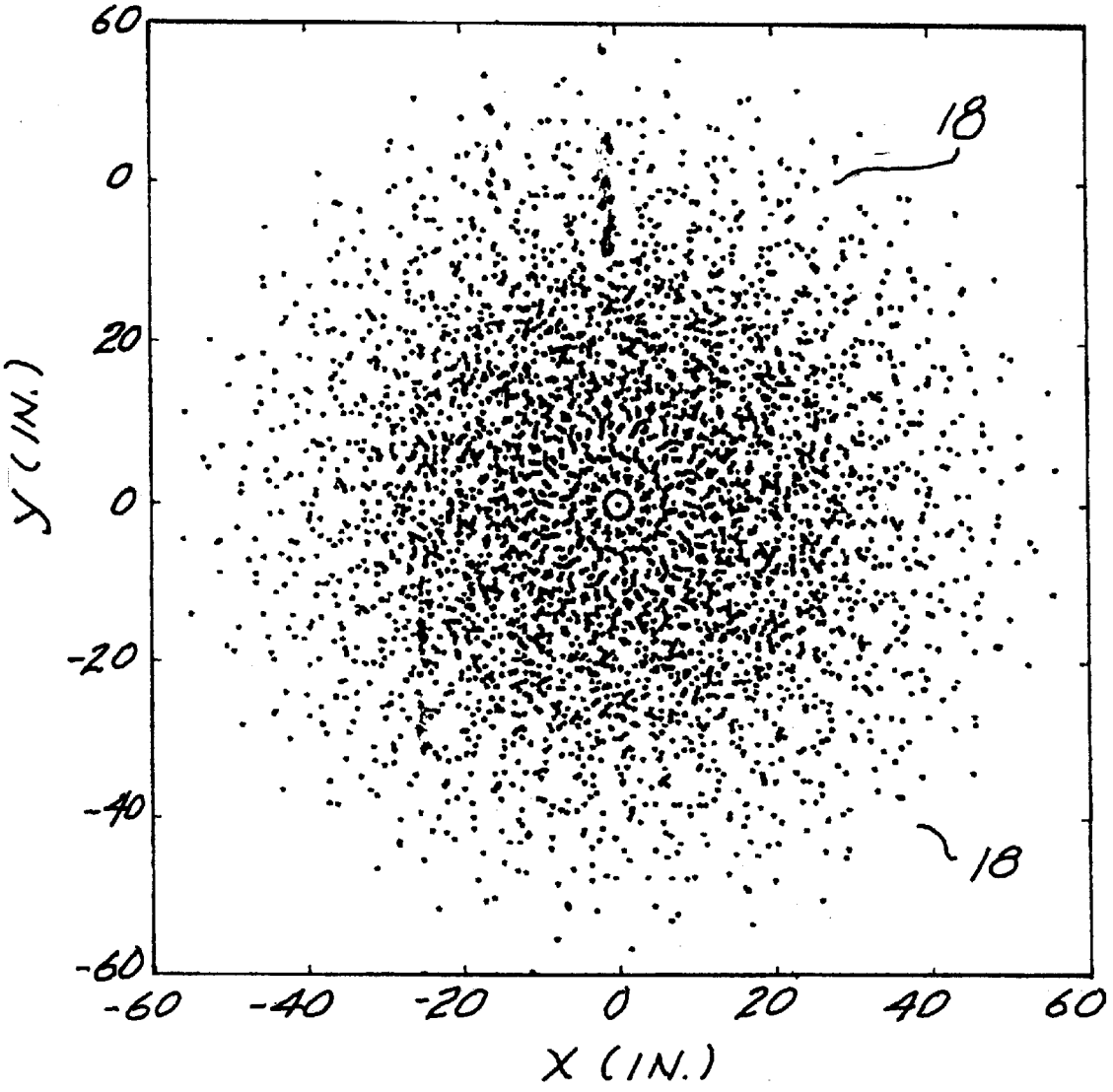
FIG. 2 is a diagrammatic view of a coarray representing the set of all vector spacings between elements in the array aperture in accordance with an embodiment of the invention.

The present planar array design 15 shown in FIG. 1 shows array elements 12 represented by circles. A subset of the elements 14 are highlighted to emphasize their distribution along a logarithmic spiral 16. The highlighted elements 14 may be located along the spiral according to any of a number of methods. One preferred method, as shown in FIG. 1, is equi-annular area sampling where the M-1 outermost elements of the M-element spiral are located coincident with the geometric radial centers of concentric equal-area annuli. The Mth element is located independently at some radius less than that of the innermost of the aforementioned M-1 elements to enhance the performance of the array at the highest frequencies for its intended use. Circular symmetry is achieved by clocking N-element circular arrays of equally spaced elements 17 off of each of the spiral elements 14 as shown in FIG. 1. If the number of elements in the circular arrays is odd, the resulting array has zero redundancy in its spatial sampling space. This is represented by the coarray shown in FIG. 2 which represents the set of all vector spacings between elements 12 in the array aperture of FIG. 1. Each point 18 in the coarray represents a vector difference between the locations of two elements in the array. For the present planar array design 15, none of these vector differences is repeated.

Figure 3:
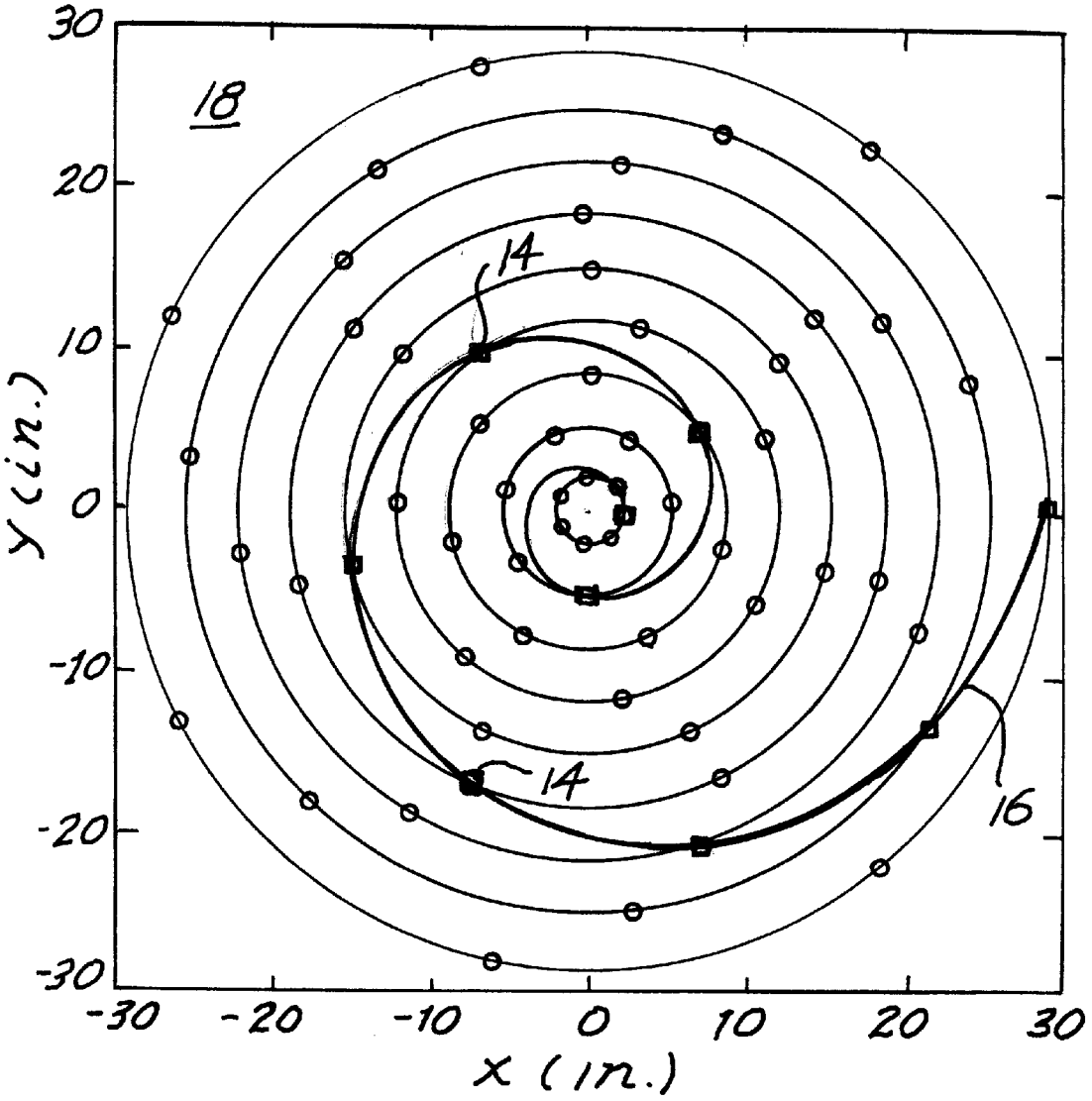
FIG. 3 is a diagrammatic view of a circular planar array made up of multiple logarithmic spiral shaped arrays with equal radial increment spaced elements in accordance with an embodiment of the invention wherein elements from one of the spirals are highlighted.
Figure 4:
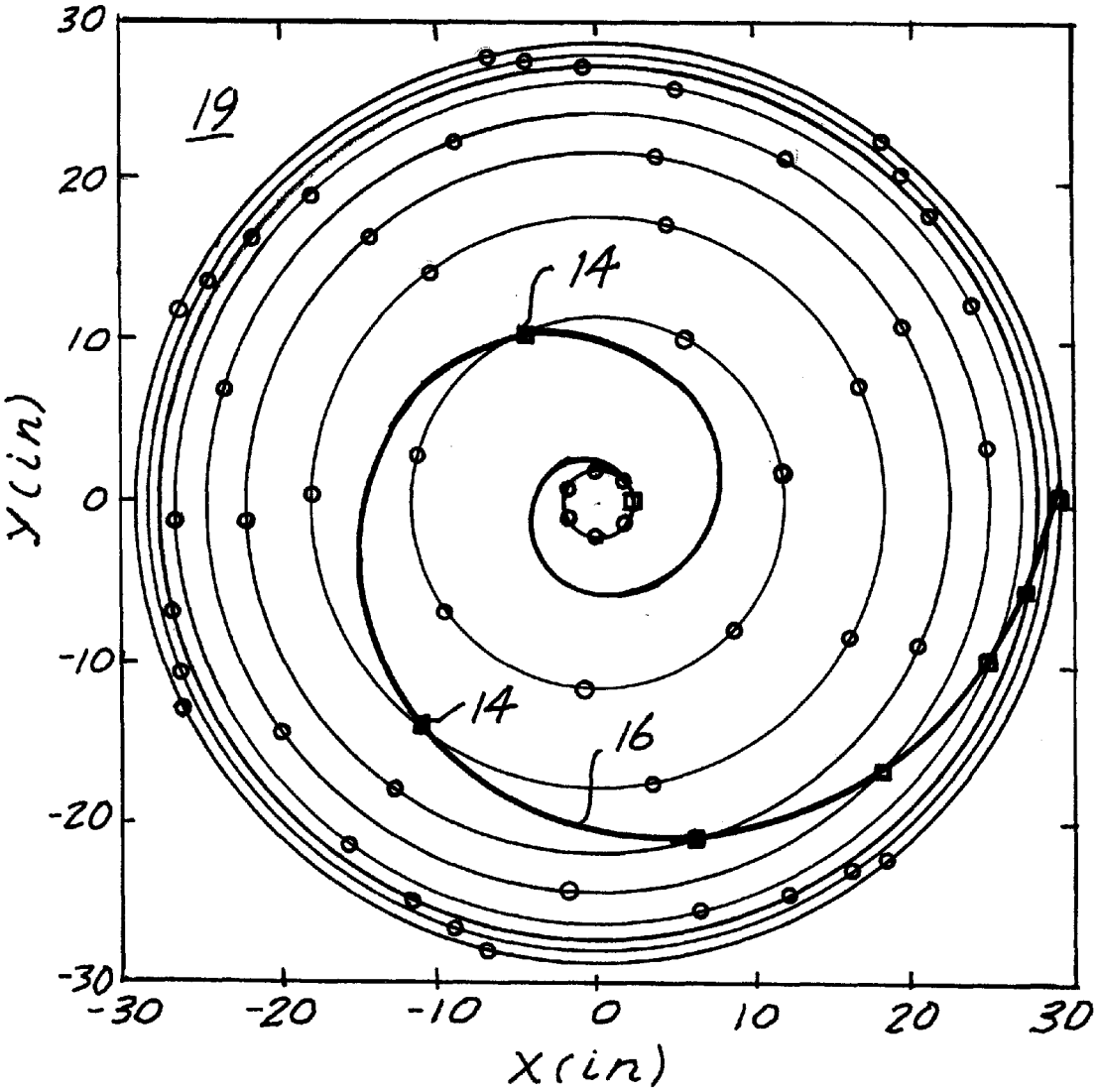
FIG. 4 is a diagrammatic view of a circular planar array made up of multiple logarithmic spiral shaped arrays with outside-in logarithmic radial increment spaced elements in accordance with an embodiment of the invention wherein elements from one of the spirals are highlighted.

Alternative spiral element spacing methods are shown in FIGS. 3 and 4. In FIG. 3 the spiral elements 14 are spaced on equal radial increments along the spiral 16 between an inner and outer radial specification. In FIG. 4 the spiral elements 14 are spaced in logarithmically increasing radial increments along the spiral 16 between an outer and inner radial specification (i.e., the radial increment between spiral elements increases as the spiral is traversed from the outermost to the innermost element). This is referred to as logarithmic radial spacing outside-in. Another method, referred to as logarithmic radial spacing inside-out locates the spiral elements on logarithmically increasing radial increments along the spiral between an inner and outer radial specification. These and other spiral element spacing methods exhibit trade-offs between array mainlobe width (i.e., array resolution) and sidelobe levels. Arrays with the elements concentrated near the perimeter such as the array 18 of FIG. 3 have a narrower mainlobe and correspondingly higher average sidelobe levels. Arrays with the elements concentrated near the center such as the array 19 of FIG. 4 have a broader mainlobe and correspondingly lower average sidelobe levels. The embodiments of FIGS. 1, 3, and 4 and the embodiment comprising logarithmic radial spacing inside-out are exemplary only of radial spacing configurations in accordance with the invention.

The general design parameters for the present arrays are as follows: (1) logarithmic spiral angle; (2) inner radius; (3) outer radius; (4) number of elements per spiral; (5) number of elements per circle (i.e., number of spirals); and (6) spiral element spacing method. These parameters form a broad class of circularly symmetric non-redundant planar arrays (provided the number of elements per circle is odd) that have exceptionally low worst-case sidelobe characteristics across a broad range of frequencies compared to what can be achieved with regular or random arrays.

Figure 5:
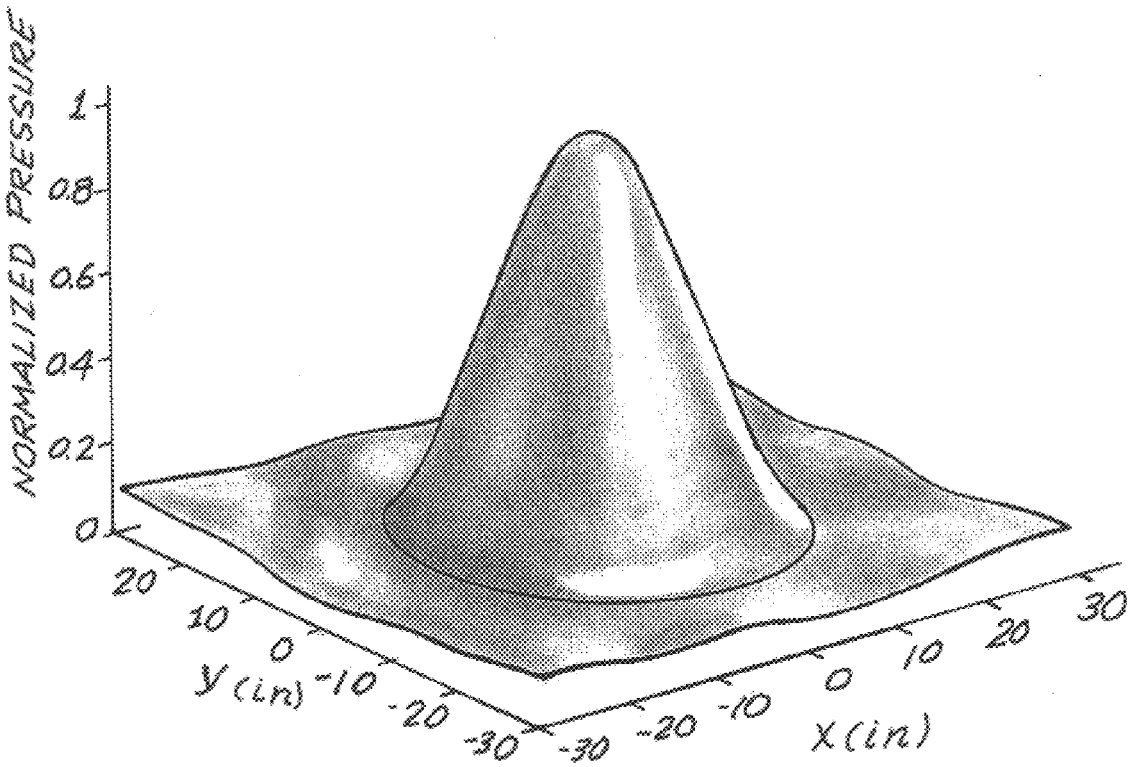
FIG. 5 is an exemplary array pattern for single frequency operation using the FIG. 1 array at 1 kHz focused at a point 54 inches off broadside.
Figure 6:
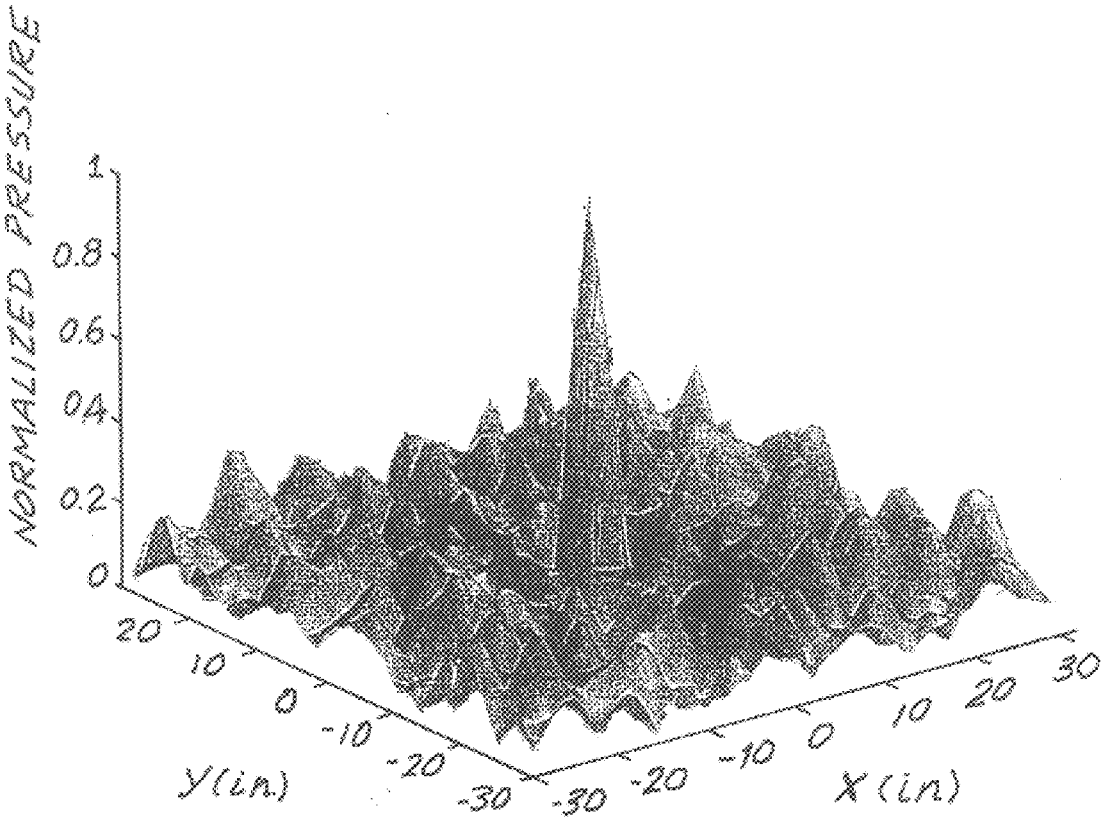
FIG. 6 is an exemplary array pattern for single frequency operation using the FIG. 1 array at 5 kHz focused at a point 54 inches off broadside.
Figure 7:
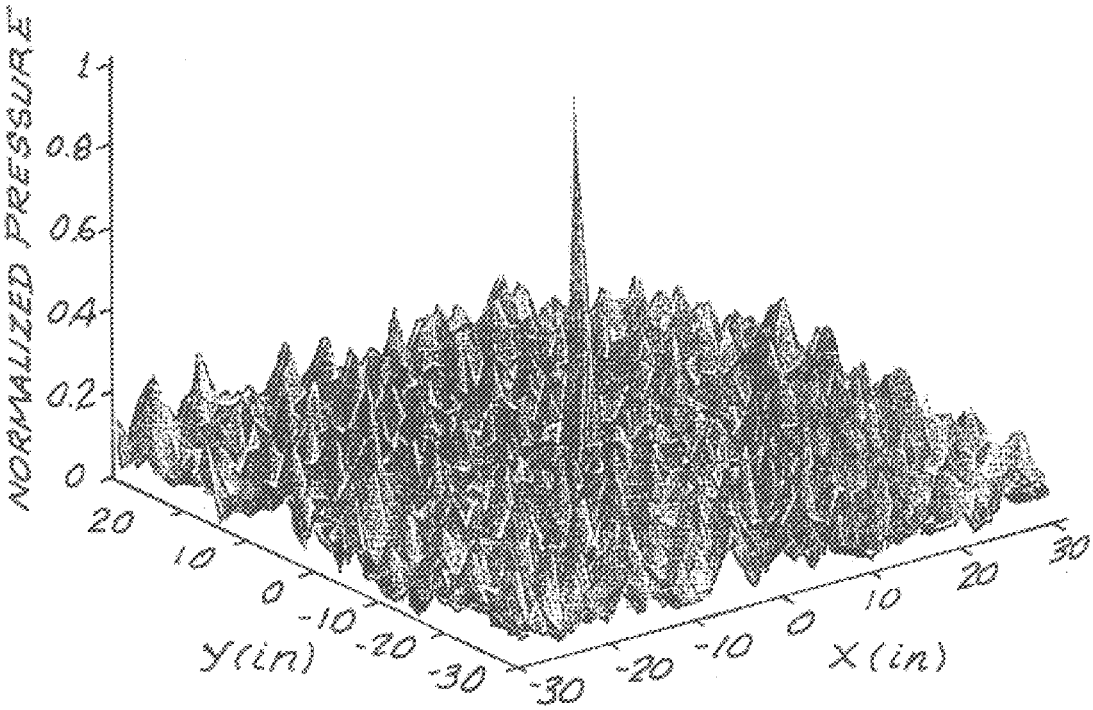
FIG. 7 is an exemplary array pattern for single frequency operation using the FIG. 1 array at 10 kHz focused at a point 54 inches off broadside.
Figure 8:
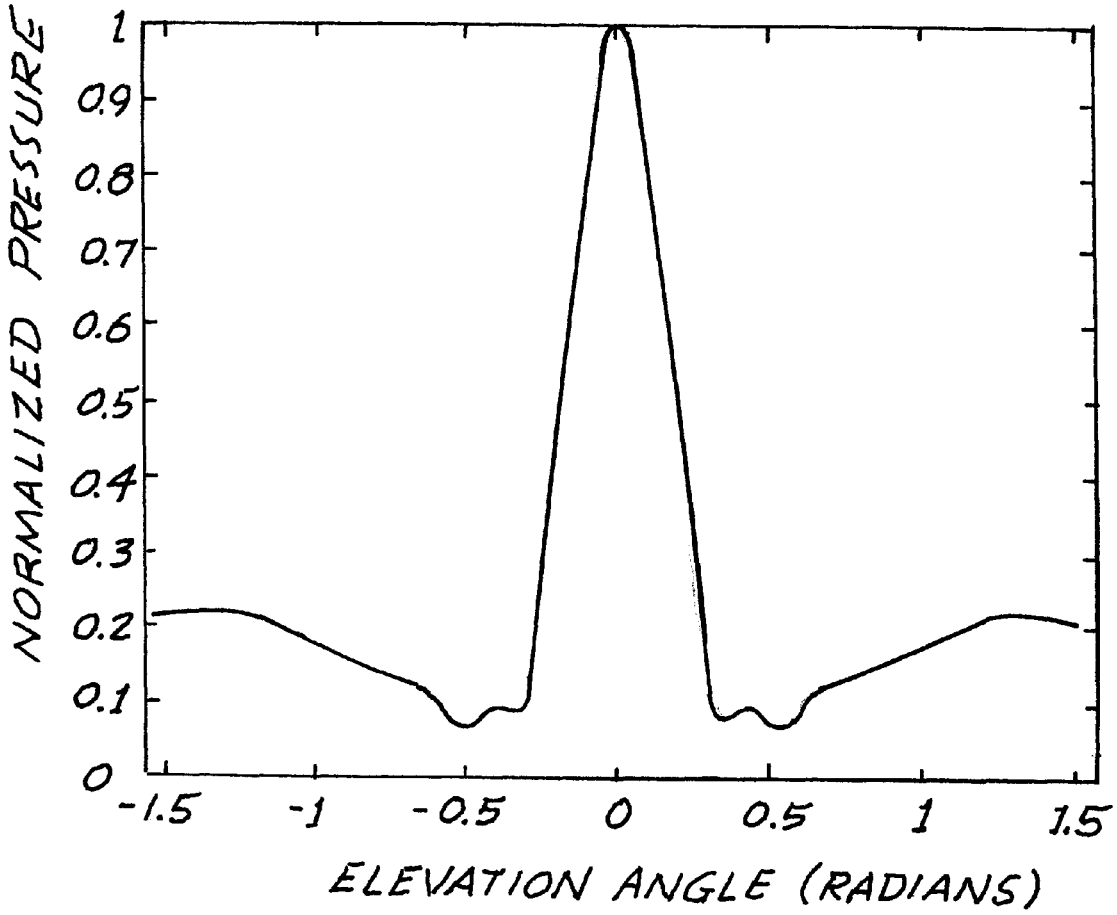
FIG. 8 is a plot of worst-case sidelobe characteristics for single frequency operation using the FIG. 1 array at 1 kHz focused at a point 54 inches off broadside.
Figure 9:
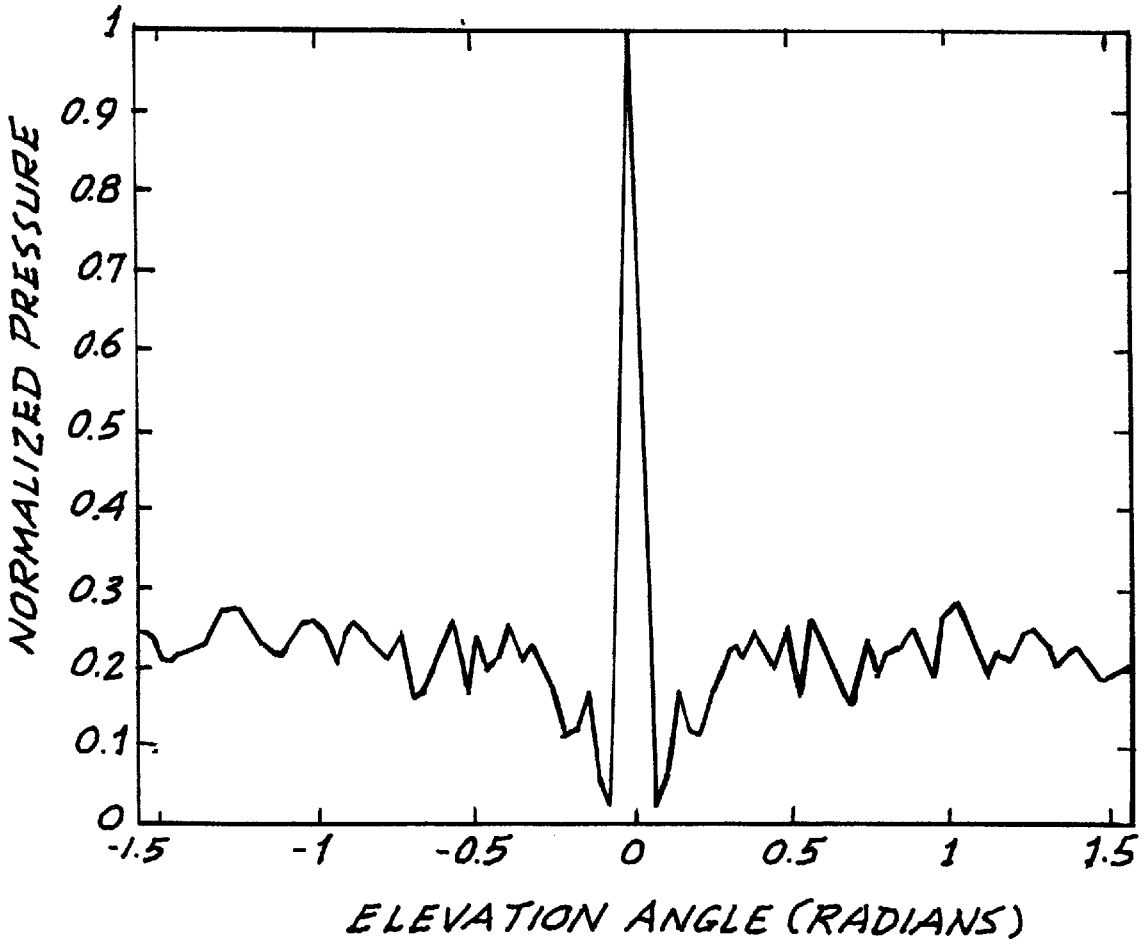
FIG. 9 is a plot of worst-case sidelobe characteristics for single frequency operation using the FIG. 1 array at 5 kHz focused at a point 54 inches off broadside.
Figure 10:
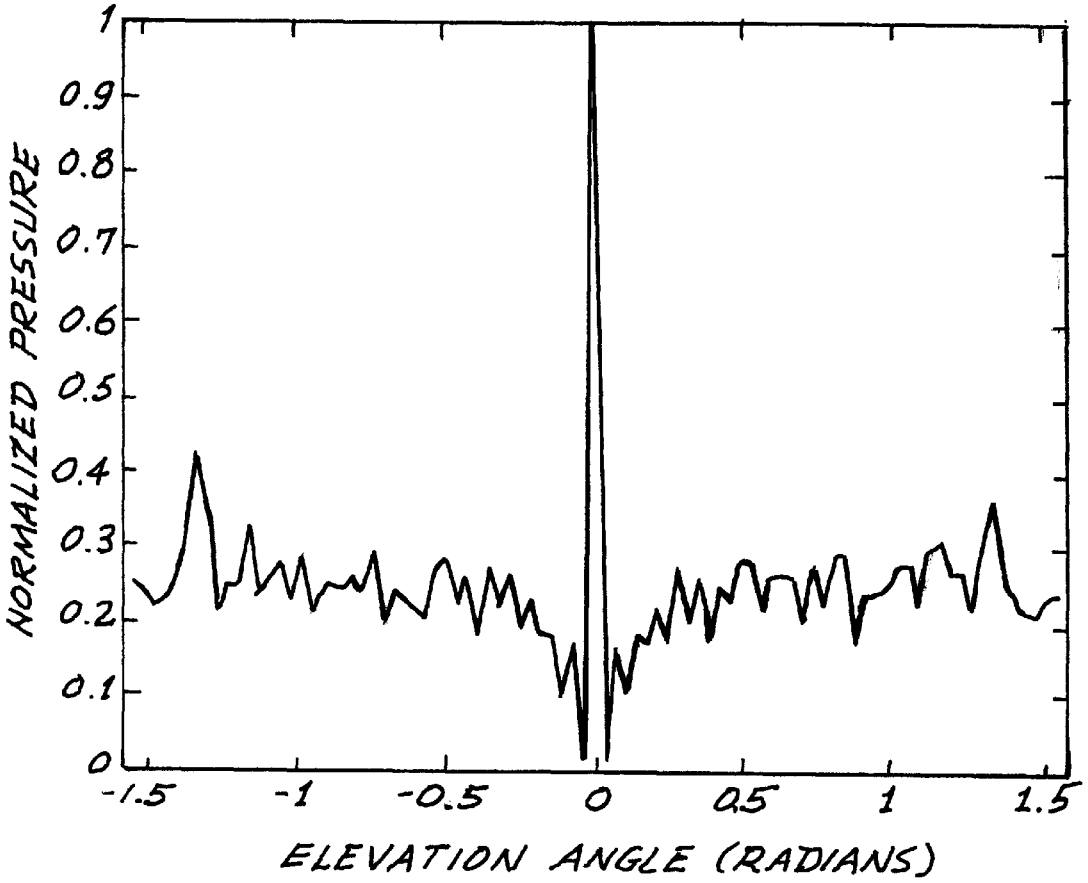
FIG. 10 is a plot of worst-case sidelobe characteristics for single frequency operation using the FIG. 1 array at 10 kHz focused at a point 54 inches off broadside; and, FIG. 11 is a block diagram illustrative showing microphone input, signal conditioning, signal processing, and display from the planar array of FIG. 1 for noise source location mapping.

Array patterns for the embodiment of FIG. 1 are shown for 1 kHz in FIG. 5, for 5 kHz in FIG. 6, and for 10 kHz in FIG. 7, with the array focused at a point 54 in. off broadside demonstrating the absence of grating lobes over a broad frequency range and broad scan region, and showing the circularly symmetric characteristics of the array. These exemplary array patterns were determined for frequencies corresponding to atmospheric propagation of acoustic waves using a propagation speed of 1125 ft./s. Worst-case sidelobe characteristics for the embodiment of FIG. 1 are shown for 1 kHz in FIG. 8, for 5 kHz in FIG. 9, and for 10 kHz in FIG. 10, demonstrating strong grating lobe suppression over a broad frequency range for$-90_{13}$ to$+90_{13}$ elevation angle with the array focused at a point 54 in. off broadside. FIGS. 8, 9, and 10 show the array pattern envelope that is formed by taking the largest value from 45 azimuthal angle cuts through the array pattern at each of 91 elevation angles.

Figure 11:
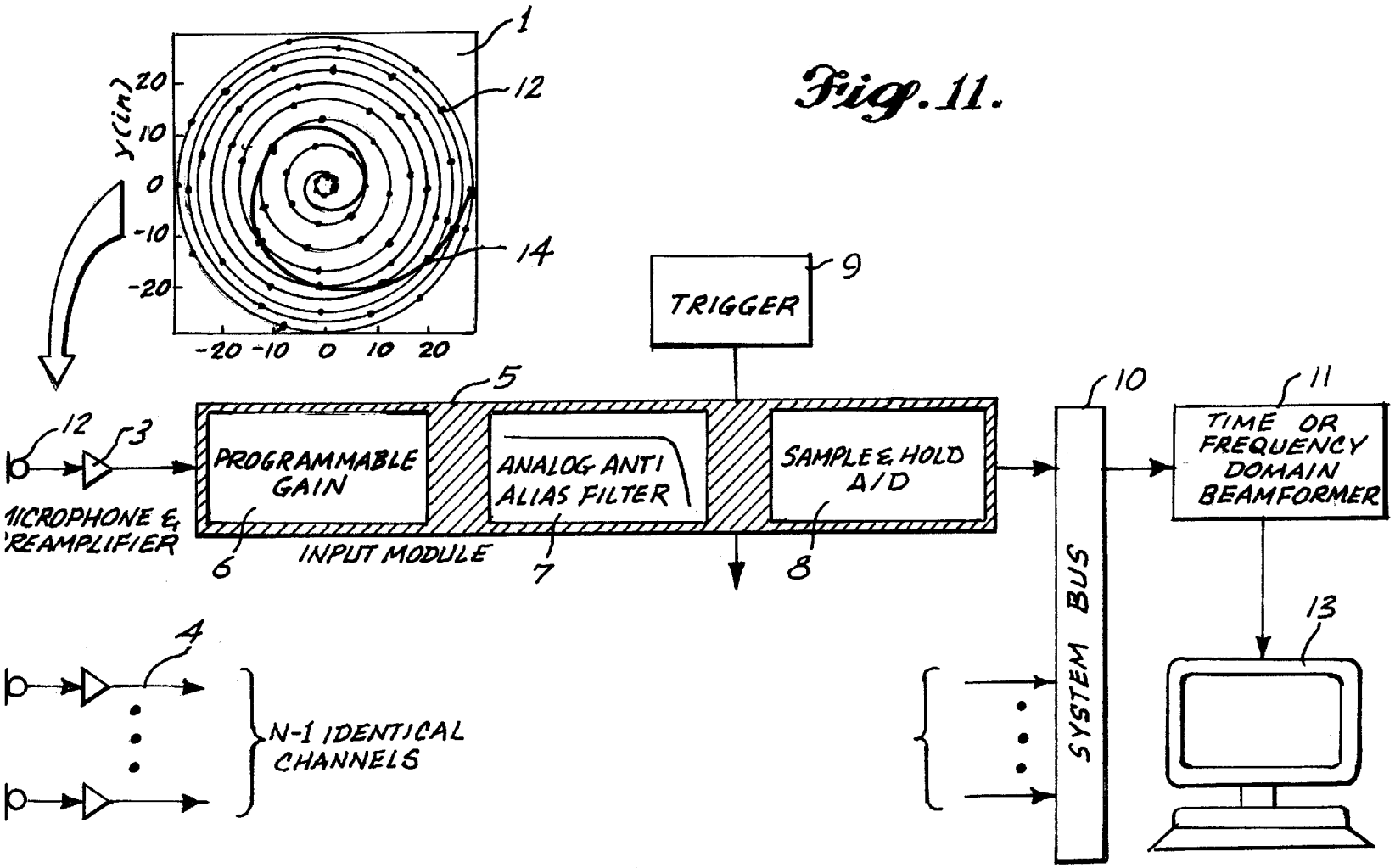

FIG. 11 shows a block diagram for the instrumentation, signal conditioning, data acquisition, signal processing, and display system for an acoustic application of the array of FIG. 1. The N-channel array design 1 is implemented by positioning N microphones at appropriate spatial locations such that the positions of the centers of the microphone diaphragms relative to each other match the array design specification (i.e., the spatial coordinates). The N microphone systems consisting of microphone button (array element) 12, pre-amplifier 3, and transmission line 4 are fed into N corresponding input modules 5. Each input channel contains programmable gain 6, analog anti-alias filter 7, and sample and hold analog-to-digital conversion 8. Input channels share a common trigger bus 9 so that sample and hold is simultaneous. A common system bus 10 hosts the input modules and channels the simultaneously acquired time series data to the beamformer 11. The beamformer may be one or more of a number of conventional time and/or frequency domain beamforming processes which provide data for readout means comprising a graphical display device 13.

As an example, a frequency domain beamformer 11 provides signal processing from the planar array of N microphone elements 12 and 14 of FIGS. 1 and 11 performing the following steps:

1. Fourier Transform to produce a narrowband signal for each channel.
2. Integrate the pairwise products of the narrowband signals in time to give the N×N correlation matrix.
3. Find the N-dimensional complex steering vector for each potential direction of arrival (plane wave beamforming case) or source location (spherical beamforming case).
4. Multiply the correlation matrix by the steering vectors to produce the estimated source power for each direction of arrival or source location.

The graphical device 13 then presents a contour plot of the estimated source distribution.

While a certain specific apparatus has been described, it is to be understood that this description is made only by way of example and not as a limitation to the scope of the invention as set forth in the objects and in the accompanying claims.

What is claimed is:

1. A broad frequency range circularly symmetric zero redundancy planar array for eliminating grating lobe contamination in source maps or projected beams comprising a plurality of sensing elements or transmitting elements spaced with various radii along a family of identical logarithmic spirals where members of the family are uniformly spaced in angle about an origin point and there are an odd number of members in the said family of identical logarithmic spirals.

2. The planar array defined in claim 1 in combination with means for receiving signal energy from each of said array elements over separate receiving paths.

3. The combination defined in claim 2 combined with means coupled to each of said receiving paths to process said signal energy to control the phase and amplitude of said array elements thereby controlling the main beam of said array.

4. The planar array defined in claim 1 in combination with means for feeding signal energy to each of said array elements over separate transmission paths.

5. The combination defined in claim 4 combined with means coupled to each of said transmission paths to process said signal energy to control the phase and amplitude of said array elements thereby controlling the main beam of said array.

6. The combinations as defined in claim 3 wherein said array elements are located along each said logarithmic spiral on concentric circles forming the geometric radial centers of equal-area annuli and on an innermost concentric circle whose radius is independently specified.

7. The combination as defined in claim 3 wherein said array elements are located along each said logarithmic spiral at equal radial increments between an inner and outer radial specification.

8. The combination as defined in claim 3 wherein said array elements are located along each said logarithmic spiral at logarithmically increasing radial increments between an outer and inner radial specification such that the radial increment between said elements along said logarithmic spiral increases as said spiral is traversed from the outermost to the innermost element.

9. The combination as defined in claim 3 wherein said array elements are located along each said logarithmic spiral at logarithmically increasing radial increments between an inner and outer radial specification such that the radial increment between said elements along said logarithmic spiral increases as said spiral is traversed from the innermost to the outermost element.

10. The combination as defined in claim 3 wherein said array elements are located along each said logarithmic spiral by means to achieve space density tapering.

11. The combination defined in claim 5 where said array elements are passive acoustic sensors (e.g., condenser microphones) and said means for receiving said signal energy and processing said signal energy to control the phase amplitude of said array elements is an N-channel signal conditioning system comprising a pre-amplifier, transmission line, and input module comprising signal conditioning and sample and hold analog-to-digital conversion capability for each channel, all input modules coupled to a common system bus connected to a data processing system for beamforming and resultant noise source map generation in the form of a contour plot.

12. The design of arrays as defined in claim 1 where specifications for logarithmic spiral angle, inner radius, outer radius, number of elements per spiral, number of spirals, and spiral element spacing method provide a circularly symmetric, zero-redundant, planar array.

13. The design of arrays defined in claim 12 where the number of elements in said arrays and outer radius of said arrays are arbitrary.

14. The combination as defined in claim 5 wherein said array elements are located along each said logarithmic spiral on concentric circles forming the geometric radial centers of equal-area annuli and on an innermost concentric circle whose radius is independently specified.

15. The combination as defined in claim 5 wherein wherein said array elements are located along each said logarithmic spiral at equal radial increments between an inner and outer radial specification.

16. The combination as defined in claim 5 wherein wherein said array elements are located along each said logarithmic spiral at logarithmically increasing radial increments between an outer and inner radial specification such that the radial increment between said elements along said logarithmic spiral increases as said spiral is traversed from the outermost to the innermost element.

17. The combination as defined in claim 5 wherein wherein said array elements are located along each said logarithmic spiral at logarithmically increasing radial increments between an inner and outer radial specification such that the radial increment between said elements along said logarithmic spiral increases as said spiral is traversed from the innermost to the outermost element.

18. The combination as defined in claim 5 wherein wherein said array elements are located along each said logarithmic spiral by means to achieve space density tapering.

* * * * *